US006189867B1

(12) United States Patent
O'Rourke et al.

(10) Patent No.: US 6,189,867 B1
(45) Date of Patent: Feb. 20, 2001

(54) LOAD-HANDLING DEVICE

(75) Inventors: Michael J. O'Rourke, Edmonton (CA); Thomas E. Coffman, Myrtle Point, OR (US)

(73) Assignee: Surety Manufacturing & Testing Ltd., Edmonton (CA)

( * ) Notice: Under 35 U.S.C. 154(b), the term of this patent shall be extended for 0 days.

(21) Appl. No.: 09/177,498

(22) Filed: Oct. 23, 1998

(51) Int. Cl.[7] ..... B66D 3/10
(52) U.S. Cl. ..... 254/391; 254/393; 254/399
(58) Field of Search ..... 254/391, 394, 254/393, 399

(56) References Cited

U.S. PATENT DOCUMENTS

| | | | | |
|---|---|---|---|---|
| D. 395,114 | | 6/1998 | Wullimann . | |
| D. 400,084 | | 10/1998 | Wullimann . | |
| 848,905 | * | 4/1907 | Jenson | 254/391 |
| 1,878,312 | * | 9/1932 | Parker | 254/391 |
| 1,890,992 | * | 12/1932 | Janssen | 254/391 |
| 1,971,511 | * | 8/1934 | Stahl | 254/391 |
| 3,714,838 | * | 2/1973 | Gilson . | |
| 3,807,696 | * | 4/1974 | Brda | 254/391 |
| 5,168,958 | | 12/1992 | Wullimann . | |
| 5,538,223 | * | 7/1996 | Scace et al. | 254/391 |
| 5,622,237 | | 4/1997 | Moldow . | |
| 5,868,380 | * | 2/1999 | Allen | 254/391 |

FOREIGN PATENT DOCUMENTS

| | | | | |
|---|---|---|---|---|
| 2053092 | | 10/1991 | (CA) . | |
| 2236033 | | 12/1995 | (CA) . | |
| 2240122 | | 6/1998 | (CA) . | |
| 728092 | * | 4/1955 | (GB) | 254/393 |

OTHER PUBLICATIONS

"ROLLGLISS The Universal Rescue and Utility System" Brochure; Breitenau 10, D–8112 Bad Kohlgrub, Landkreis Garmisch–Partenkirchen, No Date Available.

* cited by examiner

*Primary Examiner*—Katherine A. Matecki
(74) *Attorney, Agent, or Firm*—Birch, Stewart, Kolasch & Birch, LLP

(57) ABSTRACT

A load-handling device comprising a pair of pulley assemblies each having a body, at least one pulley supported by the body, and having a peripheral outer surface, a rope secured at one end to a support structure and entrained about each of the outer surfaces to interconnect the pulleys in a load-handling arrangement. Each of the pulley assemblies include a one way clutch acting between the body and the pulley to inhibit rotation relative to the body in one direction. The surfaces of the pulleys thereby providing frictional engagement for the rope in the one direction to facilitate handling of the load.

9 Claims, 3 Drawing Sheets

LOAD-HANDLING DEVICE

BACKGROUND OF THE INVENTION

The load-handling devices may be used to raise or lower loads and will typically provide a mechanical advantage to the user to facilitate the handling of loads. One of the most common forms of load handling device with a mechanical advantage is a pulley arrangement in which a pair of pulleys are interconnected by a rope. One of the pulleys is connected to a fixed support and the other connected to the load and the entrainment of the rope around the pulleys enables the load to be raised or lowered. The mechanical advantage obtained will depend upon the number of pulleys used in the train.

One application for such a load-handling device is for use with rescue teams in which it is frequently necessary to lift or lower an injured person. In those circumstances a pulley system would be utilized to give the necessary mechanical advantage to the rescuer. With a conventional arrangement of pulley system it is necessary to control the lowering of the load by maintaining a restraining force that is the same as the force required to lift the load. In certain circumstances this may be onerous, particularly where the rescue is occurring in a hazardous environment.

It is therefore an object of the present invention to provide a load-handling device in which the above disadvantages are obviated or mitigated.

SUMMARY OF THE INVENTION

In general terms the present invention provides a load handling device comprising of a pair of pulley assemblies each having a body at least one pulley supported by the body. The pulley has a peripheral outer surface and a rope secured at one end to a support structure and entrained bout each of said outer surfaces interconnects the pulleys in a load handling arrangement. Each of said pulley assemblies includes a one way clutch acting between the body and the pulley to inhibit rotation relative to the body in one direction. The surfaces thereby provide frictional engagement for said rope in the one direction to facilitate handling of said load.

The present invention also encompasses a pulley assembly having a body, a pulley mounted on the body and a one way clutch acting between the pulley and the body to inhibit rotation of said pulley relative to said body in one direction.

BRIEF DESCRIPTION OF THE DRAWINGS

An embodiment to the invention will now be described by way of example only with reference to the accompanying drawings in which.

DETAILED DESCRIPTION OF A PREFERRED EMBODIMENT

Figure 1:
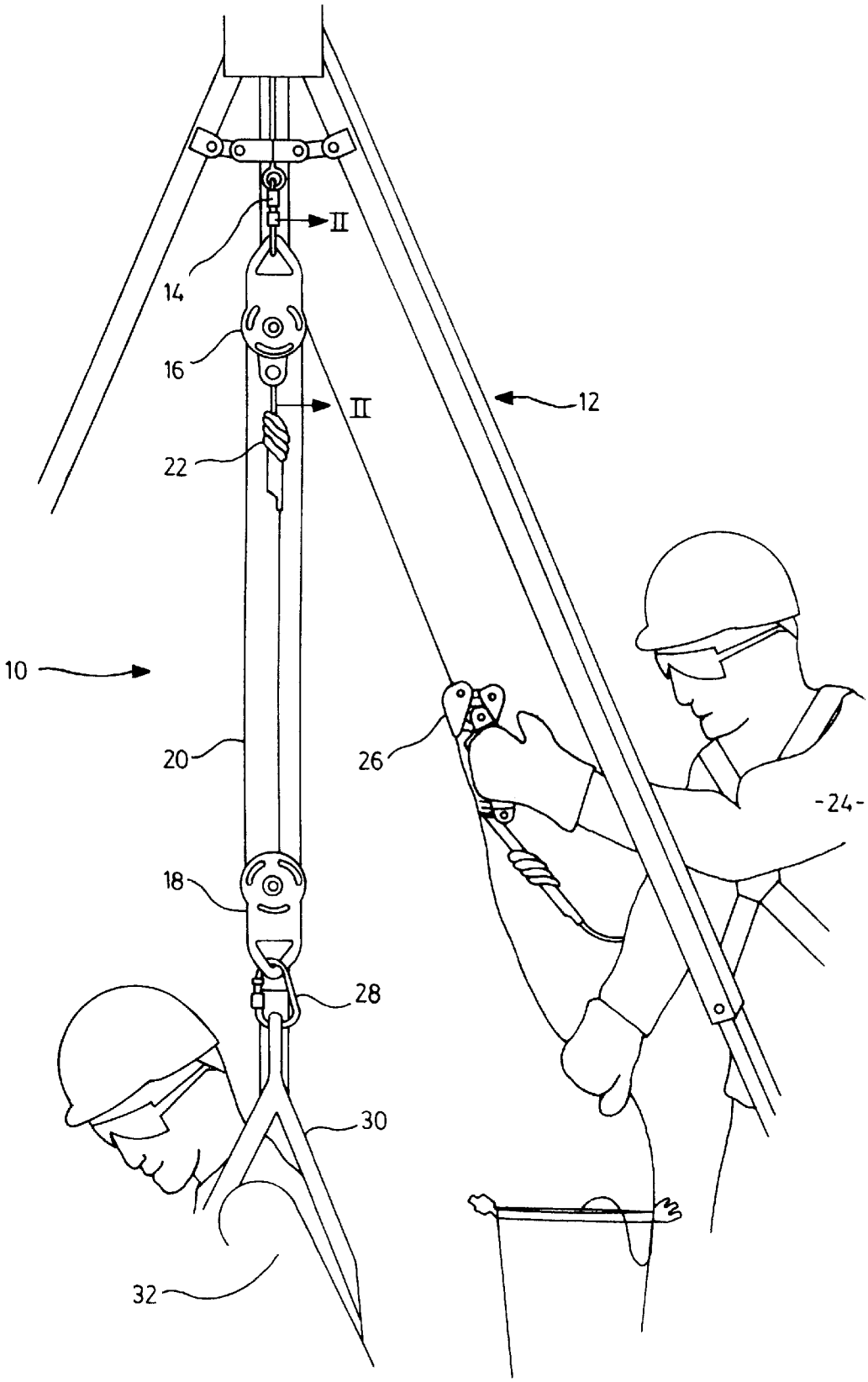
FIG. 1 is a side elevation of a load-handling device being used in a rescue environment.

Referring therefore to FIG. 1, a load-handling device generally indicated at 10, is suspended from a tripod 12 by means of a carabiner 14 or similar releasable attachment. The load-handling device 10 includes upper and lower pulley assemblies 16, 18 which are interconnected by a rope 20 and trained about the pulley assemblies 16, 18. One end indicated at 22 of the rope 20 is secured to the upper pulley assembly 16 and the opposite end of the rope 20 is available for manipulation by a rescuer indicated at 24. An ascender 26 is used to grip the rope 20 and is slideable along the rope as it is deployed in a well-known manner.

The lower pulley assembly 18 is secured by a carabiner 28 to a harness 30 on a person 32 to be rescued enabling the person to be handled safely and efficiently.

Figure 2:
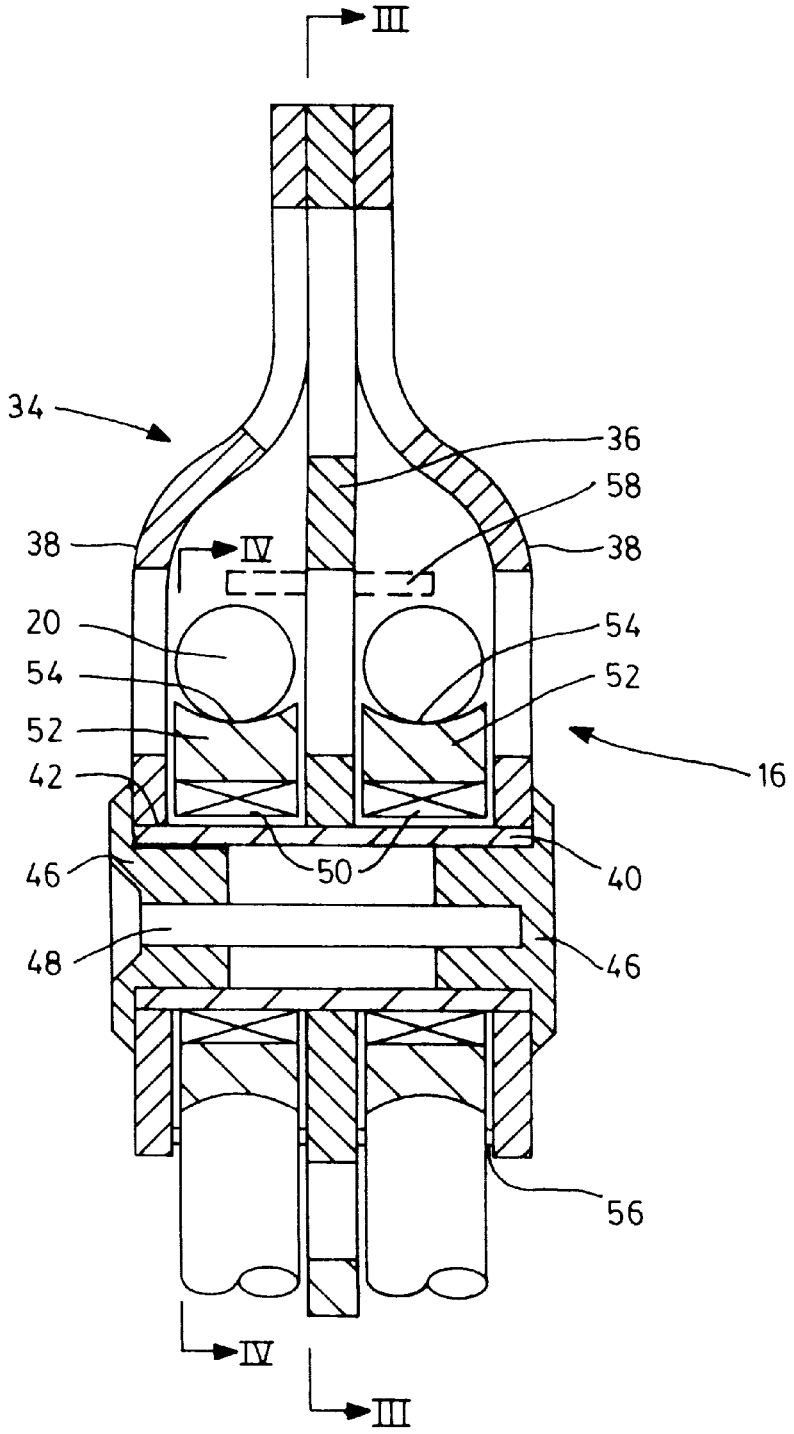
FIG. 2 is a view on the line at II—II of FIG. 1.

As best seen in FIG. 2, each of the pulley assemblies 16, 18 includes a body 34 having a central web 36 and a pair of side webs 38. A shaft 40 is secured to the central web 36 and projects laterally to each of the side webs where it is located in bores 42. A pair of pins 44 (FIG. 3) extend through the body of the shaft 40 into the central web 36 and inhibit rotation of the shaft 40 relative to the body 34.

The side webs 38 are secured to the shaft 40 by end caps 46 with a bolt 48 extending between the end caps 46. Each of the webs are free to rotate relative to each other, about the axis of shaft 40.

A one way roller clutch 50 is mounted on the shaft 40 on either side of the central web 36. The roller clutch 50 is a self-contained unit commercially available from the Torrington, USA under part number TORR RC162110. The roller clutch 50 includes a cage and needle rollers which are arranged to permit rolling action relative to the shaft 40 in one direction but inhibit rotation in the opposite direction. As the details of the clutch 50 are well known from the commercial available units they will not be described in further detail at this time.

A pulley 52 is a press fit on the clutch 50 and includes a peripheral part circular outer surface 54 dimensioned to receive rope 20.

The clutches 50 associated with each of the pulleys 52 are arranged to inhibit rotation in the same direction relative to the shaft 40 but operates to rotatively support the pulleys on the shaft for rotation in the opposite direction.

To ensure that the rope 20 remains entrained on the pulley 52 a pair of pins 56 extend between the side webs 38 and also inhibits movement of the rope 20 from the pulley assemblies. These pins may as shown in ghosted outline alternatively be attached at a position 58, extending from opposite sides of the central web 36.

Figure 3:
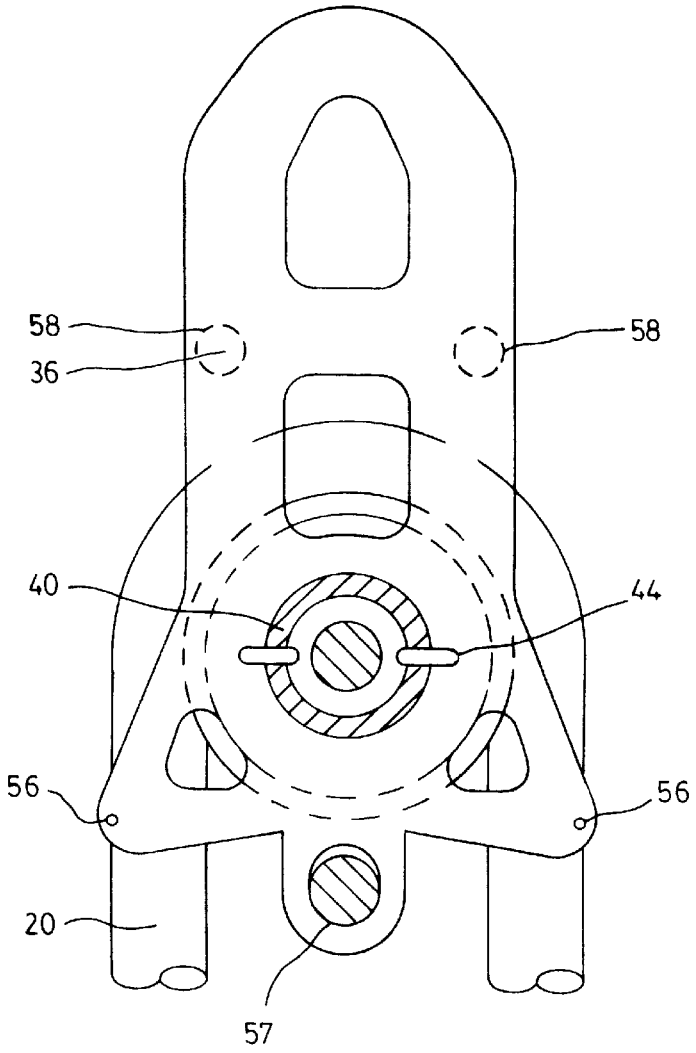
FIG. 3 is a view on the line at III—III of FIG. 2.
Figure 4:
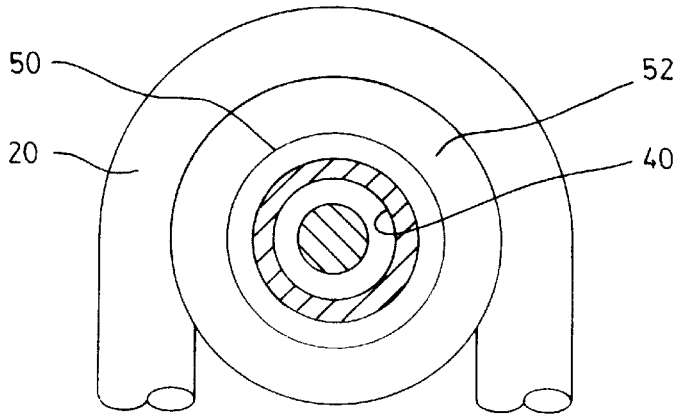
FIG. 4 is a detailed view on the line of IV—IV of FIG. 2.

In use, as can best be seen from FIGS. 1 and 3, the rope 20 is entrained around a portion of each outer surface 54 of each of the pulleys 52. The rope passes from an aperture 57 provided on the central web 36 of the upper pulley and around one pulley of the lower pulley assembly 18. The 30 rope then passes to the upper pulley assembly 16 where it is entrained around one of the pulleys 52 and back to the lower pulley assembly 18 where it is entrained around a second of the pulleys 52. Finally the rope 20 passes back to the upper pulley assembly 16 for entrainment about the second pulley 52. The wrap of the rope 20 around the 4 pulleys provides a 4 to 1 mechanical advantage for the rescuer 24 allowing him to safely lift the load presented by the injured person 32. To elevate the person 32, the rescuer 30 pulls the rope 20 in a direction to reduce the distance between the upper and lower pulley assemblies 16, 18 and the clutches 50 are arranged to permit rotation on the shaft in that direction.

To lower the person 32, it is desirable that a reduced load is required to permit a controlled descent. To lower the person 32 therefore the rope 20 is supplied to the pulley assemblies in a direction to increase space in between the upper and lower pulley assemblies 16, 18. The clutches 50 inhibit rotation of the pulleys 52 on the shaft 40 and therefore causes the rope 20 to slide across the peripheral surface 54. The surfaces 54 therefore provide a frictional resistance to the passage of the rope 20 to reduce the restraining load required to lower the person 32.

The multiple pulleys 52 provide sufficient wrap of the rope on the peripheral surface to contribute a significant braking force to the lowering of the person 32.

It will be appreciated that additional pulleys 52 may be incorporated into the pulley assembly 16, 18 to provide an enhanced mechanical advantage and corresponding increase in the wrap of the rope or single pulleys might be used in each of the pulley assembly if sufficient mechanical advantages are provided.

Although the invention has been described with reference to certain specific embodiments, various modifications thereof will be apparent to those skilled in the art without departing from the spirit and scope of the invention as outlined in the claims appended hereto.

What is claimed is:

1. A load-handling device comprising a pair of pulley assemblies each pulley assembly having a body, a plurality of pulleys supported by said body and a one way clutch acting between each of said pulleys and said body, each pulley having a peripheral outer surface, a rope secured at one end to a support structure and entrained about each of said outer surfaces to interconnect said pulleys in a load-handling arrangement, said one way clutches acting between said body and respective ones of said pulleys to inhibit rotation relative to said body in one direction, each of said surfaces thereby providing frictional engagement for said rope in said one direction to facilitate handling of said load.

2. A load-handling device according to claim 1, wherein each of said pulley assemblies includes a pair of pulleys.

3. A load-handling device according to claim 2, wherein each of said pairs of pulleys is disposed on opposite sides of a central support web forming part of said body.

4. A load handling device according to claim 3, wherein said body includes a pair of laterally spaced side webs disposed on opposite sides of said central web and said pulleys are located between adjacent pairs of webs.

5. A load handling device according to claim 4, wherein a shaft extends between said side webs through said central web and said pulleys are mounted on said shaft.

6. A load-handling device according to claim 5, wherein said one way clutches are disposed between respective ones of said shafts and said pulleys.

7. A load-handling device according to claim 6, wherein said one way clutches are roller clutches.

8. A load-handling device according to claim 1, wherein each of said pulleys is mounted on a shaft and said one way clutches are interposed between respective ones of said pulleys and said shaft.

9. A load-handling device according to claim 8, wherein said one way clutches are roller clutches and operable to support said pulleys for rotation in a direction opposite to said one direction.

* * * * *